US005326326A

United States Patent [19]

Cunard et al.

[11] Patent Number: 5,326,326

[45] Date of Patent: Jul. 5, 1994

[54] CHILDREN'S SWING

[75] Inventors: Joel C. Cunard; Robert J. Boudreau, both of Bedford, Pa.

[73] Assignee: Hedstrom Corporation, Bedford, Pa.

[21] Appl. No.: 84,413

[22] Filed: Jun. 29, 1993

Related U.S. Application Data

[63] Continuation of Ser. No. 30,667, Mar. 12, 1993.

[51] Int. Cl.[5] ..... A63G 9/00

[52] U.S. Cl. ..... 472/118; 403/400

[58] Field of Search ..... 472/118-125, 472/108, 111; 248/300, 58, 228, 229; 297/244; 403/400

[56] References Cited

U.S. PATENT DOCUMENTS

| | | | |
|---|---|---|---|
| 555,981 | 3/1896 | Streeter | 248/61 |
| 1,657,243 | 1/1928 | Daniels | 248/300 |
| 1,939,223 | 7/1932 | Palmer | 248/65 |
| 2,823,002 | 2/1958 | Savitz | 248/65 |
| 3,503,582 | 3/1970 | Boucher | 472/118 |
| 4,018,538 | 4/1977 | Smyrni et al. | 403/346 |
| 4,961,558 | 10/1990 | Cunard | 248/370 |

FOREIGN PATENT DOCUMENTS

| | | | |
|---|---|---|---|
| 662727 | 3/1927 | Australia | 403/400 |

*Primary Examiner*—Carl D. Friedman
*Assistant Examiner*—Kien Nguyen
*Attorney, Agent, or Firm*—Cesari and McKenna

[57] ABSTRACT

A children's swing has an elongated beam with opposite ends and a mid portion providing a seating platform for at least two children. Pivotally attached to the opposite ends of the beam are a pair of rigid rockers, each rocket having an upper end defining hand grips and a lower end defining a foot rest. To use the rocker, the children sit on the beam back with their hands and feet on the hand grips and foot rests of the rockers in front of them. When the children rock the rockers in synchronism, the swing will swing to and fro with ever increasing amplitude due to the inertia of the children's limbs and changes in the included angles between the rockers and the beam.

18 Claims, 3 Drawing Sheets

CHILDREN'S SWING

RELATED APPLICATION

This application is a continuation of Ser. No. 08/030,667, filed Mar. 12, 1993.

FIELD OF THE INVENTION

This invention relates to a children's swing. It relates more particularly to a swing which can be used by two children simultaneously.

BACKGROUND OF THE INVENTION

Children's swings are usually supported above the ground by an overhead support, such as the crossbar of a play gym. The most common type of swing is a simple seat which is suspended from the overhead support by a pair of ropes or chains. That type of swing is usually used by a single rider, although it has been known for two children to stand on a swing facing each other and to propel the swing by shifting their weights in unison.

There is also a swing called a glide ride which is composed of a pair of rigid parallel hangers which hang down from the overhead support. A beam is pivotally connected at its midpoint to the lower ends of the hangers and seats are formed at the opposite ends of the beam to support two children. When the children shift their weight in unison, the beam swings to and fro while remaining more or less parallel to the ground.

Both of the above types of swings are disadvantaged in that they have no parts with which a child can interact to effect the motion of the swing. In other words, there is nothing for the children to do except to hold on to the ropes or hangers supporting the swing seats.

SUMMARY OF THE INVENTION

Accordingly, it is an object of the present invention to provide a children's swing which can be used by two children simultaneously.

Another object of the invention is to provide a swing of this type on which two children can sit facing away from each other and independently control the movement of the swing.

Yet another object of the invention is to provide a tandem swing which can be assembled by the purchaser without any special tools or fixtures.

Yet another object of the invention is to provide such a swing which is easy and safe to use.

Other object of the invention will, be obvious and will, in part, appear hereinafter.

The invention accordingly, comprises the features of construction, combination of elements and arrangement of parts which will be exemplified in the construction hereinafter set forth and the scope of the invention will be indicated in the claims.

Briefly, my children's swing includes a relatively long rigid beam and two panel-like rockers pivotally connected to the opposite ends of the beam such that the nominal planes of the rockers are more or less perpendicular to the longitudinal axis of the beam. The beam provides seats for two children facing away from each other and toward the rockers and the rockers are configured to provide hand grips and foot supports for those children. The two rockers are suspended from an overhead support by chains or other suitable means so that the swing can swing to and fro, i.e., in the general direction of the beam axis.

To operate the swing, the two children rock or pivot their respective rockers with respect to the beam in unison by pushing or pulling on the tops of the panels with their hands while pulling or pushing on the bottoms of the rockers with their feet. The pivoting motion of each rocker changes the angle that the chains supporting that rocker make with the overhead support, and also changes the elevation of that end of the beam. Thus, each rider, by manipulating a rocker and shifting his or her weight can affect the motion of the swing. The two riders can choose to synchronize their motions and thus apply a maximum impulse to the swing so that it operates in resonance. Alternatively, one of the riders can operate the corresponding rocker so as to interfere with or obstruct the swinging motion being encouraged by the other rider. Thus, a variety of different swinging actions may be achieved to hold the children's interests.

The swing itself is composed for the most part of molded plastic parts which are rugged, reliable and resistant to the weather. Special pivotal connections to be described in more detail later connect the opposite ends of the beam to the two rockers so as to maximize the strength of the swing at those locations and to limit the excursions of the rockers relative to the beam for safety reasons. The swing can be shipped in a knocked-down condition and assembled by the purchaser without any special tools or equipment. For all of these reasons, the swing should find wide acceptance in the marketplace.

BRIEF DESCRIPTION OF THE DRAWINGS

For a fuller understanding of the nature and objects of the invention, reference should be had to the following detailed description, taken in connection with the accompanying drawings, in which.

DETAILED DESCRIPTION OF ILLUSTRATIVE EMBODIMENT

Figure 1:
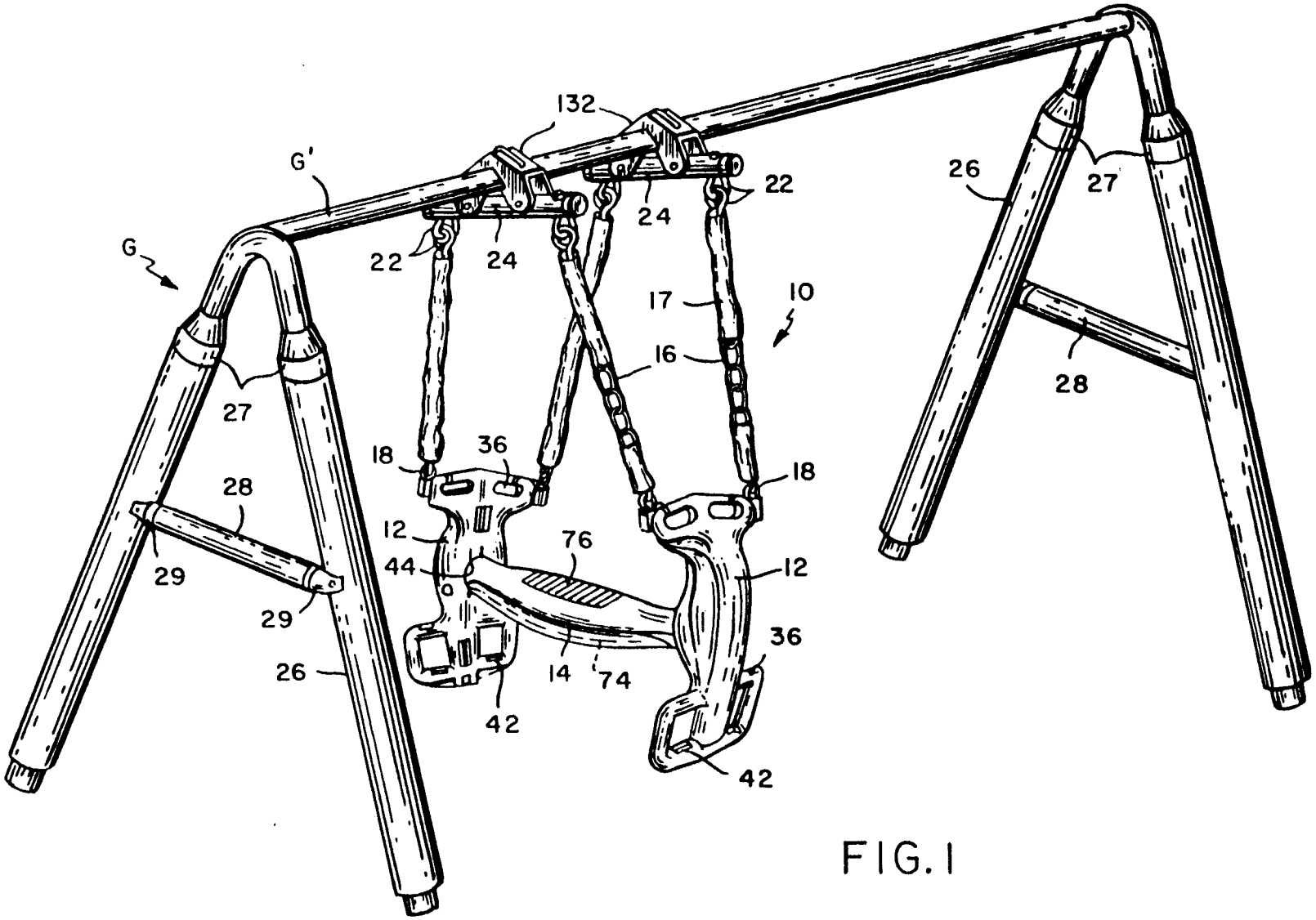
FIG. 1 is an isometric view of a tandem swing incorporating the invention.

Referring to FIG. 1 of the drawing, the subject swing, shown generally at 10, is suspended from an overhead support such as the crossbar 24G' of a conventional A-frame play gym G. Swing 10 includes a pair of mirror image rigid rockers 12 each being about 2 feet long, pivotally connected at their mid points to the opposite ends of a relatively long, e.g., 32 inches, rigid beam 14. Each rocker 12 is supported by a pair of chains 16, each being about 4 feet long, the lower ends of the chains being linked to eye bolts 18 present at the upper corners of each rocker. The chains may be covered by plastic sheaths 17. The upper ends of the two chains 16 from each rocker 12 are connected via conventional links 22 to corresponding first ends of a pair of relatively short, e.g., 16 inches, pipes 24 or channels 24' (FIG. 4 in phantom) clamped crosswise to the crossbar 25G'. The similar pair of chains 16 extending up from the other rocker 12 are likewise linked to the opposite ends of those same pipes.

Figure 4:
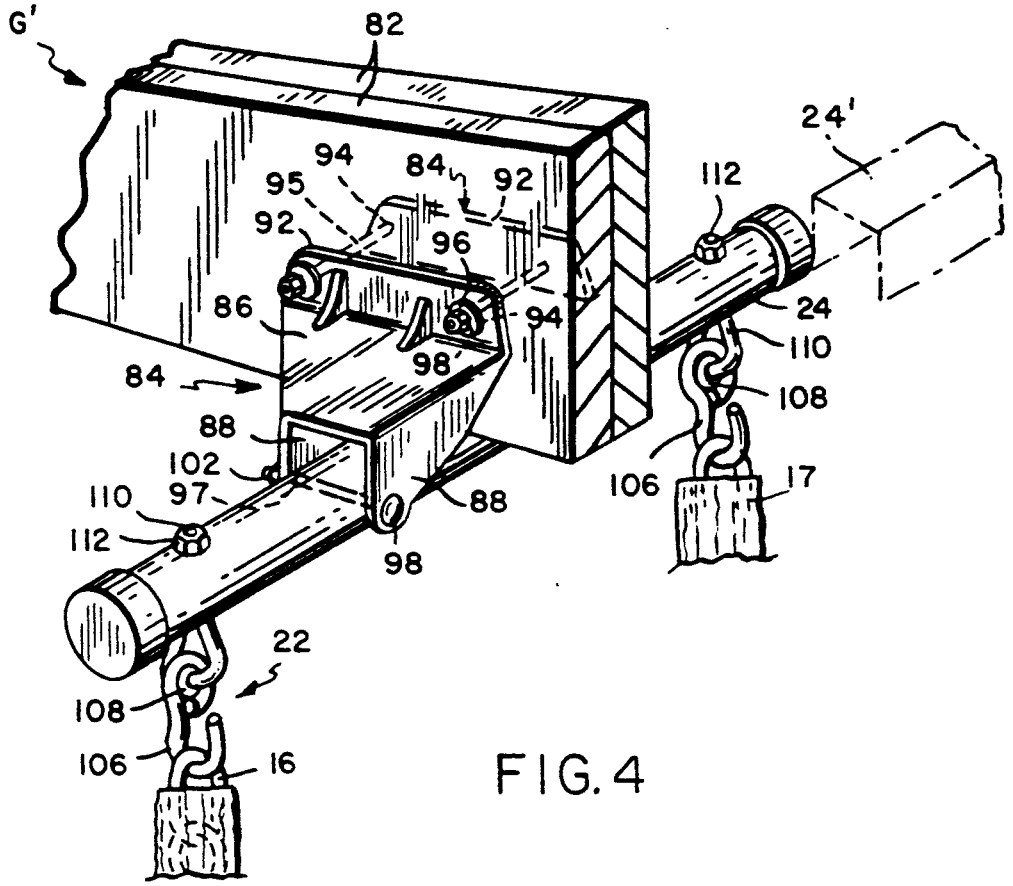
FIG. 4 is a fragmentary isometric view showing the connection of the swing to a wood plank support.

The links 22 between the chains 16 and the pipes 24 may consist of conventional S-hooks and eye bolts with or without nylon bearings as is well known in the art; see FIG. 4. Also, the two pipes 24 are spaced along the crossbar G' a distance which is more or less equal to the widths of rockers 12, e.g., about 14 inches. Thus, when swing 10 is at rest, the beam 14 is more or less horizontal and the rockers and chains 16 converge toward the pipes 24. That is, the longitudinal axis of each rocker makes an acute angle with the longitudinal axis of the beam 14.

Preferably, the legs of the play gym G are covered by plastic foam sheaths 26 terminated by tubular plastic end caps 27. Similar sheaths 28 and end caps 29 are provided on the A-frame cross members of the gym G.

Figure 2:
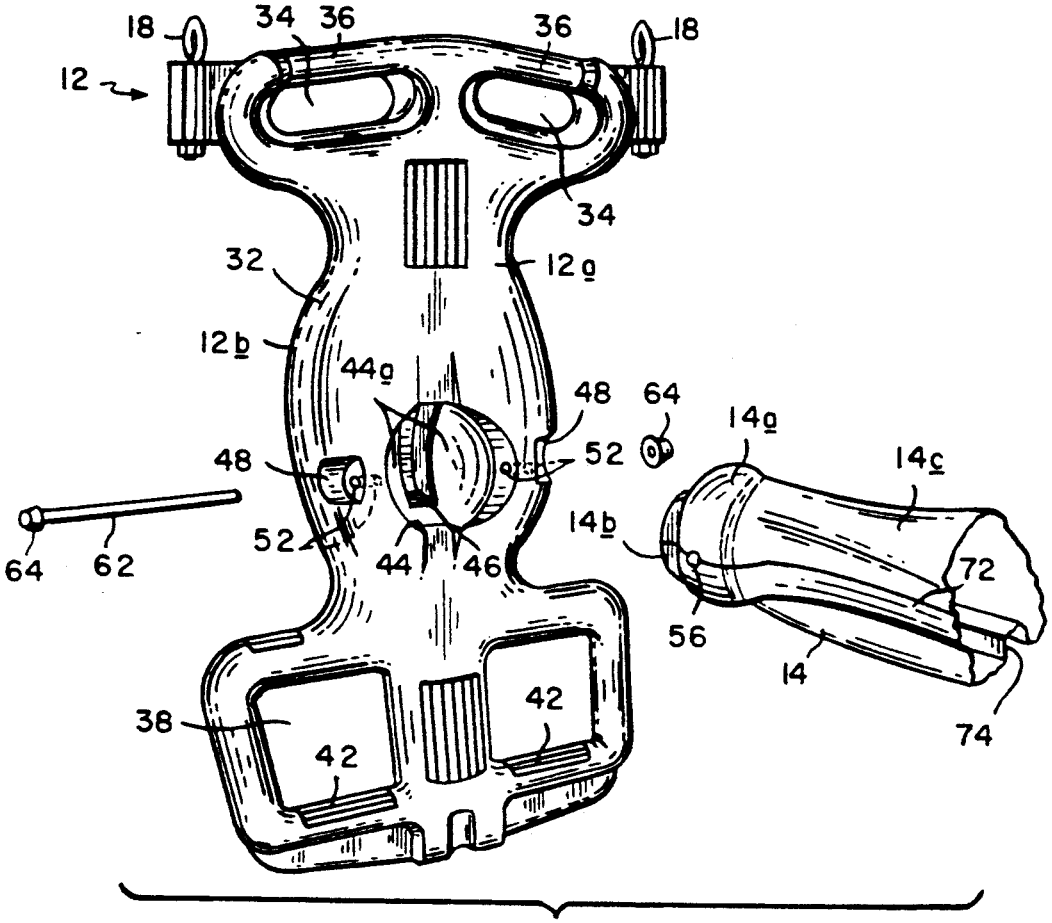
FIG. 2 is an exploded isometric view showing portions of the swing in greater detail.

Referring now to FIG. 2, each rocker 12 is composed of a pair of inner and outer molded plastic shell-like panels **12*a* and 12*b* which are welded together at their edges by welds 32 to form a strong, rigid, hollow light-weight structure. Each rocker 12 has a relatively wide upper end which is formed with a pair of openings 34 to define a pair of hand grips 36 at the upper end of the rocker. The bottom of the rocker is also relatively wide to accommodate relatively large side-by-side openings 38 that define a pair of foot supports or stirrups 42**. With also a fat mid section, each rocker resembles somewhat the front of a motor bike.

Formed in the middle of the inner rocker panel **12*a* is a generally semi-circular recess 44. Present in the wall of that recess is a channel 46 having a generally rectangular cross section and which extends along the longitudinal axis of rocker 12. Thus, hemispherical segments 44*a* of recess 44 exist on each side of channel 46. Formed in the side walls of panel 12*a* are a pair of dimples 48 which are aligned on an axis which extends perpendicular to the longitudinal axis of the rocker and to the direction of channel 46. Present in the bottom walls of those dimples as well as in the wall of recess 44, is a series of holes 52** which are aligned along the transverse axis of the rocker.

The recess 44 in each rocker 12 is arranged to receive a generally hemispherical bulb **14*a* formed at the corresponding end of beam 14. A generally trapezoidal nose 14*b* present at each end of beam 14 is arranged to project into the channel 46 when bulb 14*a* is inserted into recess 44. A pair of lateral holes 56 are provided in the side walls of bulb 14*a* which, when the bulb is inserted into recess 44, is aligned with the holes 52 in rocker 12. To secure the beam to the rocker, a rod 62 is passed through the holes 52 and 56 so that the opposite ends of the rod project into the dimples 48. The rod is secured in place by a pair of locking caps 64 press fit onto the exposed ends of the rod in the two dimples 48**.

Figure 3:
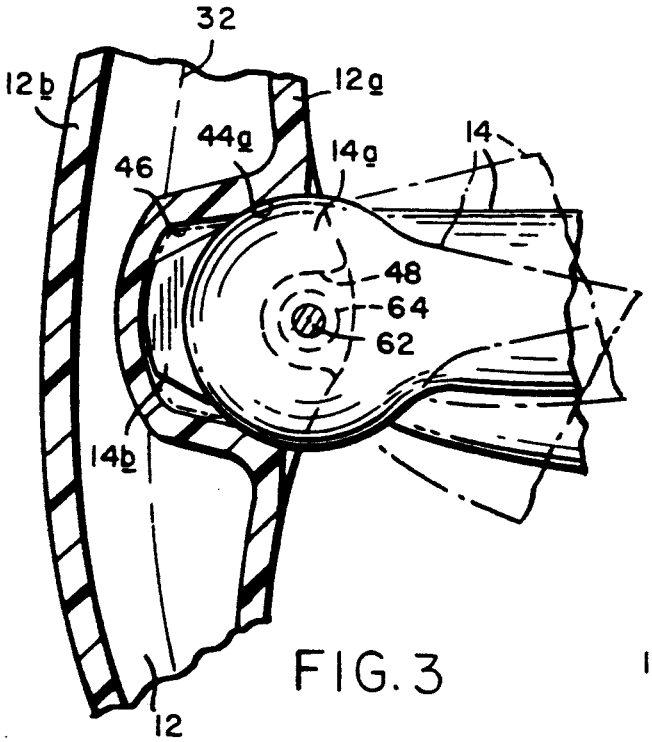
FIG. 3 is a fragmentary elevational view with parts in section showing a rocker hinge connection on the FIG. 1 swing.

As best seen in FIG. 3, the sliding engagement of the beam nose **14*b* in the channel 46 of rocker 12 controls the relative motion of those two members so that the beam cannot rotate about its longitudinal axis relative to the rocker. Also, the rocking excursion of rocker 12 relative to beam 14 is limited by the engagement of nose 14 with the opposite ends of groove 46. Typically, the angular excursion of the rocker 12 is such that the included angle A (FIGS. 6A and 6B**) between the longitudinal axis of the rocker and the longitudinal axis of the beam may vary from about 70° to about 130°.

As shown in FIGS. 1 and 2, the beam 14 is a hollow structure composed of upper and lower shells **14*c* and 14*d* which are connected together at their edges by a seam weld 72. A longitudinal channel 74 is formed in the underside of shell 14*d* to rigidify beam 14 and a rippled embossment 76 is present on shell 14*c*** to define seat or saddle areas for the two riders.

Referring now to FIG. 4, the pipes 24 that support swing 10 may be mounted to a crossbar G' which consists of one or more wood planks 82, e.g., 2×6's. In this case, each pipe is secured to the underside of the plank(s) by a pair of mirror-image brackets 84. Each bracket comprises a generally trapezoidal main body 86 with a pair of laterally spaced apart ears 88 extending down from the side edges of that body so as to bracket a pipe 24. An integral flange 92 extends along the upper edge of main body 86 with the flange being angled with respect to the main body such that when the ears 88 are more or less perpendicular to pipe 24, flange 92 lies flat against the side of a plank 82. A pair of holes 94 are formed in flange 92 for receiving fasteners to anchor the flange to the plank(s). Thus, in the illustrated arrangement, a bolt 95 extends through each hole 94 and through the planks 82 and through a corresponding hole of the bracket 84 on the opposite side of crossbar G'. A nut 96 is tightened onto the threaded end of each bolt 95 to anchor the bolt in place. Also, a pair of colinear holes 97 are present in ears 88. These holes are aligned with similar holes (not shown) in the opposite walls of pipe 24. A bolt 98 is passed through these holes and secured in place by a nut 102. Thus secured, the two brackets 84 firmly anchor each pipe 24 to the underside of the wood crossbeam G'.

As also seen in FIG. 4, the chains 16 are secured to the opposite ends of each pipe 24 by an S hook 106 whose upper loop contains an annular nylon bearing 108. The hook hooks to an eye bolt 110 which extends up through the pipe and is anchored in place by a nut 112.

Figure 5:
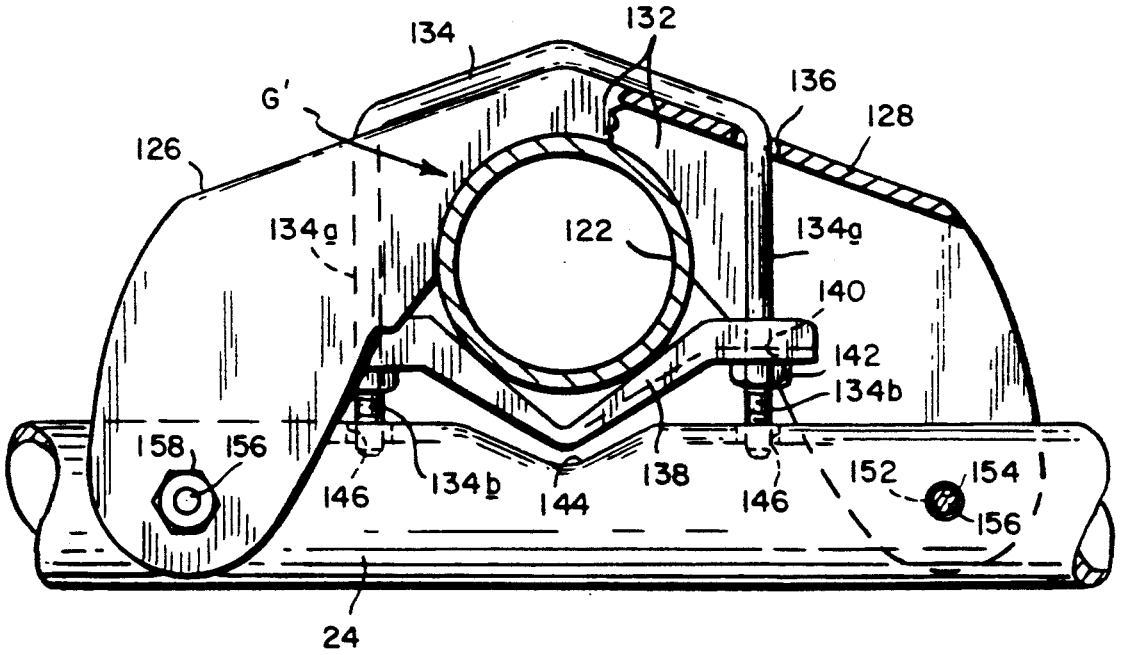
FIG. 5 is a side elevation with parts broken away showing the connection of the swing to a tubular support.

Swing 10 may also be suspended from a crossbar G' consisting of a metal tube or pipe 122 as shown in FIG. 5. In this case, the connection between each pipe 24 and the tubular crossbar 122 comprises a rigid metal saddle 126 having a top wall 128 and a pair of mirror image lobe-like side walls 132 which extend down on opposite sides of crossbar 122 well below the crossbar so that they can bracket a pipe 24 engaged crosswise against the underside of crossbar 122. Saddle 126 is secured to crossbar 122 by a heavy, generally U-shaped wire clamp member 134 whose legs **134*a* extend down through openings 136 provided in the saddle top wall 128. A second mating clamp member 138 engages under crossbar 122. It has openings 140 at its opposite ends for receiving legs 134*a* and the end segments of those legs are threaded at 134*b* to receive nuts 142, which when tightened down, firmly clamp saddle 126 to crossbar 122**.

As shown in FIG. 5, each pipe 24 is positioned under crossbar 122 between the two side walls of the saddle 126. A relatively large dimple or depression 144 may be formed in the upper wall of each pipe 24 to provide clearance for the clamp member 138. Also, openings 146 may be provided in the top wall of each pipe 24 to provide clearance for the threaded ends **134*b* of the clamp member 134**.

Aligned holes 152 are provided in the side walls 132 of saddle 126 in each lobe of the saddle. These are arranged to align with holes 154 present in the side walls of pipe 24 so that a bolt 156 can be passed through all those holes and secured in place by a nut 158. Using this clamped saddle arrangement, there is a very strong securement of each pipe 24 to the crossbar 122 despite the fact that the engaging portions of those two members are rounded and oriented at right angles.

Figure 6A:
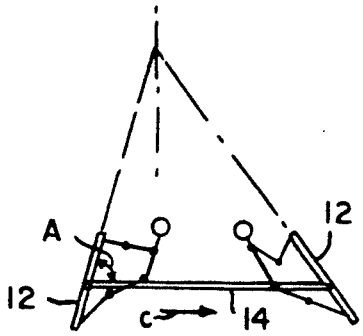
FIGS. 6A and 6B are diagrammatic views illustrating the operation of the swing.
Figure 6B:
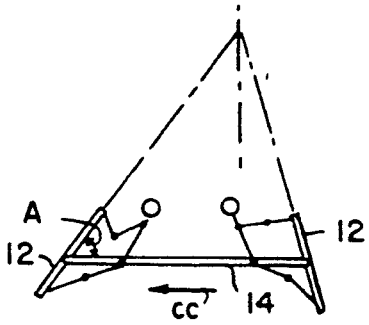

Referring now to FIGS. 6A and 6B, to use the swing, two children sit on beam 14 facing away from each other and place their hands around the grips 36 and their feet in the stirrups 42 of the rockers 12 in front of them. Then they commence rocking their respective rockers about the ends of the beam with their hands and feet. For example, if both children rotate their rockers in a counterclockwise direction as shown in FIG. 6A, the inertia caused by the leg extension of the right hand child and the leg bending of the left hand child will cause the swing to swing toward the right, or counterclockwise, as shown by the arrow C in FIG. 6A. When the swing reaches the end of its right hand swing, the two children may rotate their respective rockers in the opposite or clockwise direction. The resulting inertia caused by the leg extension of the left hand child and the leg bending of the right hand child will cause the swing to swing toward the left, or clockwise, as shown by the arrow CC in FIG. 6B. If this process is repeated at the end of each swing, the swing 10 will swing to and fro with an ever increasing amplitude. However, as the engagements of the noses **14*b* on the ends of beam 14 with the end walls of the channels 46 on the respective rockers 12** limit the pivoting motion of the rockers relative to the beam, they also limit the amplitude of the swing excursions to safeguard the children on the swing.

At any time while the swing is in motion, one or both of the children can choose to operate the swing independently by rotating a rocker 12 in the opposite direction from that of its counterpart at the opposite end of beam 14. This not only reduces the total inertia that propels the swing, it also changes the distance between the pivot rod 62 at that end of beam 14 and the pivot links 22 at the top of the swing. If, for example, the right hand child in FIG. 6A were to pivot the corresponding rocker 12 in the counterclockwise direction while the swing were moving to the right, this would lift the right hand end of the beam 14 thereby exerting a force tending to oppose the right hand or counterclockwise movement of the swing. Thus, by properly rotating the rockers 12, the two riders can exert profound influences on the swinging motion of the swing and can choose to operate cooperatively or antagonistically, depending upon their inclinations. In either event, the swing should provide a great deal of enjoyment for the children.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

It should also be understood that the following claims are intended to cover all the generic and specific features of the invention described herein.

We claim:

1. A children's swing comprising a swing platform;

elongated suspension means having opposite ends;

connecting means for connecting one end of the suspension means to the swing platform;

a bracket for securing the other end of the suspension means to a wood support beam, said bracket being constituted by a rigid unitary sheet metal having a generally trapezoidal main section, a flange extending from the base of the main section for positioning flat against a support beam, a pair of spaced-apart ears extending from the sides of the main section for bracketing said other end of suspension means, means defining a pair of flange holes in said flange and means defining aligned ear holes in said pair of ears, said ear holes defining a pivot axis that extends between said pair of ears parallel to said flange, and fastener means for extending through said ear holes into said other end of the suspension means.

2. The swing defined in claim 1 wherein said fastener means comprise a bolt extending through said ear holes and said suspension means.

3. The swing defined in claim 1 and further including a second bracket, said second bracket being a mirror image of the first bracket such that the two brackets can be positioned with their flanges engaging opposite sides of a support beam such that the corresponding flange holes of the two brackets are in substantial alignment;

second elongated suspension means having opposite ends;

second connecting means connecting one end of the second suspension means to the swing platform, and second fastener means for extending through the ear holes of the second bracket into the other end of said second suspension means.

4. The swing defined in claim 3 and further including a wood support beam, and threaded fasteners extending through the flange holes of each bracket into the support beam.

5. The swing defined in claim 4 wherein said fastener means comprise bolts.

6. The swing defined in claim 4 wherein said ear holes are located below the underside of said support beam.

7. The swing defined in claim 4 wherein said support beam comprises at least one wood plank.

8. The swing defined in claim 3 wherein the suspension means include a rigid cross member which extends between, and is connected to, the first and second brackets.

9. The swing defined in claim 8 wherein the cross member is connected to said bracket ears by said first and second fastener means.

10. The swing defined in claim 9 wherein said cross member is a metal tube.

11. The swing defined in claim 9 wherein said cross member is a metal channel having a generally U-shaped cross section.

12. A children's swing comprising a swing platform;

first and second hanger means each having upper and lower ends;

connector means connecting the lower end of each hanger means to said swing platform;

suspension means connecting the upper ends of said first and second hanger means to an overhead horizontal wood support beam, said suspension means including a pair of mirror-image brackets for positioning on opposite sides of the support beam, each bracket having a main section with a pair of laterally spaced-apart ears extending from the main section and bracketing a different one of the two suspension means and an integral upstanding flange which is angled with respect to the main section and ears such that when the flange engages flat against the adjacent side of the support beams, the ears of each bracket are substantially vertical, means defining a pair of flange openings in each of said flanges, and means defining aligned ear openings in the pair of ears of each bracket, and fastener means extending through the ear openings of each bracket into the hanger means bracketed by the ears of each bracket.

13. The swing defined in claim 12 wherein said suspension means also include a rigid cross member having opposite end portions and extending between said brackets under the support beam, and means for connecting opposite end portions of the cross member to the associated bracket ears.

14. The swing defined in claim 13 wherein the cross member is a generally U-shaped metal channel.

15. The swing defined in claim 13 wherein the cross member is a metal tube.

16. The swing defined in claim 12 and further including a wood support beam engaged between said brackets such that the corresponding flange openings of the brackets are in substantial alignment, and threaded fasteners extending through said flange openings into the support beam.

17. A children's swing comprising an elongated horizontal wood support beam;

a child support;

a pair of elongated hangers having upper and lower ends; means for connecting the lower ends of the hangers to the child support at spaced-apart locations thereon, and suspension means for connecting the upper ends of the hangers to said support beam, said suspension means including a pair of mirror-image brackets positioned on opposite sides of aid support beam, each bracket having a generally trapezoidal main section, a generally vertical flange extending from the base of the main section and positioned flat against the corresponding side of the support beam, a pair of laterally spaced-apart ears extending from the sides of the main section and bracketing the other end of a different one of the hangers, means defining a pair of flange holes in each bracket flange, the corresponding flange holes of the two brackets being in substantial alignment, and means defining aligned ear holes in the pair of ears of each bracket, said ear holes of each bracket defining a horizontal pivot axis;

threaded fasteners extending through the flange openings of each bracket into the support beam, and fastener means extending through the ear holes of each pair of ears and the other end of the associated hanger.

18. The swing defined in claim 17 wherein the support means further includes a rigid cross member extending between said brackets, said cross member having opposite end portions which are bracketed by the associated pair of bracket ears, and the fastener means also extend through said cross member portions.

* * * * *

UNITED STATES PATENT AND TRADEMARK OFFICE

CERTIFICATE OF CORRECTION

PATENT NO : 5,326,326

DATED : July 5, 1994

INVENTOR(S) : Joel C. Cunard, et. al.

It is certified that error appears in the above-identified patent and that said Letters Patent is hereby corrected as shown below:

Column 6, line 8, claim 1, after "metal" inserted --plate--.

Column 7, line 18, claim 12, "beams" should be --beam--;

Signed and Sealed this

Eleventh Day of October, 1994

*Attest:*

*Attesting Officer*

Bruce Lehman

BRUCE LEHMAN

*Commissioner of Patents and Trademarks*